US008117712B2

(12) United States Patent
Dyson et al.

(10) Patent No.: US 8,117,712 B2
(45) Date of Patent: Feb. 21, 2012

(54) CLEANING APPLIANCE

(75) Inventors: James Dyson, Malmesbury (GB); William Robert James White, Malmesbury (GB); William Frame Milne, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 290 days.

(21) Appl. No.: 12/307,254

(22) PCT Filed: Jul. 6, 2007

(86) PCT No.: PCT/GB2007/002532

§ 371 (c)(1),
(2), (4) Date: Jul. 31, 2009

(87) PCT Pub. No.: WO2008/009887

PCT Pub. Date: Jan. 24, 2008

(65) Prior Publication Data

US 2009/0282639 A1 Nov. 19, 2009

(30) Foreign Application Priority Data

Jul. 18, 2006 (GB) ..... 0614238.4
Sep. 20, 2006 (GB) ..... 0618493.1

(51) Int. Cl.
*A47L 5/24* (2006.01)

(52) U.S. Cl. ..... 15/344; 15/327.2; 15/353

(58) Field of Classification Search ..... 15/344, 15/350, 352, 353, 327.2, 327.7, 328, 329; 55/328, 329, 337, DIG. 3
See application file for complete search history.

(56) References Cited

U.S. PATENT DOCUMENTS

| | | | | |
|---|---|---|---|---|
| 5,938,410 | A | 8/1999 | Lee | |
| 6,073,302 | A | 6/2000 | Buscher | |
| 2002/0189048 | A1 | 12/2002 | Maruyama et al. | |
| 2005/0132528 | A1 * | 6/2005 | Yau | 15/344 |
| 2006/0090290 | A1 | 5/2006 | Lau | |
| 2010/0115726 | A1 * | 5/2010 | Groff et al. | 15/344 |

FOREIGN PATENT DOCUMENTS

| | | |
|---|---|---|
| EP | 1 452 118 | 6/2005 |
| GB | 1 207 278 | 9/1970 |
| GB | 2 035 787 | 6/1980 |
| JP | 48-54260 | 7/1973 |
| JP | 2-131732 | 5/1990 |
| JP | 8-196489 | 8/1996 |

(Continued)

OTHER PUBLICATIONS

Japanese Exam Report mailed Nov. 15, 2010 directed towards Application No. JP-2009-520030; 2 pages.

(Continued)

*Primary Examiner* — Dung Van Nguyen
(74) *Attorney, Agent, or Firm* — Morrison & Foerster LLP

(57) ABSTRACT

A handheld cleaning appliance includes a dirty air inlet, a clean air outlet and separating apparatus for separating dirt and dust from an airflow in an airflow path leading from the air inlet to the air outlet. The appliance also includes a body housing a fan and motor for drawing air into the appliance via the dirty air inlet. The separator includes at least one cyclone. The separator and the body are releasably connected together around a chamber in the airflow path which is formed partly by the body and partly by the separator, the chamber housing a filter which is located upstream of the fan and motor and downstream of the cyclone.

8 Claims, 4 Drawing Sheets

FOREIGN PATENT DOCUMENTS

| | | |
|---|---|---|
| JP | 2001-353110 | 12/2001 |
| JP | 2003-61878 | 3/2003 |
| JP | 2005-95677 | 4/2005 |
| WO | WO-03/022120 | 3/2003 |
| WO | WO-03/047412 | 6/2003 |
| WO | WO-2004/069021 | 8/2004 |

OTHER PUBLICATIONS

GB Search Report, dated Oct. 11, 2006, directed to counterpart GB Patent Application No. 0614238.4; 1 page.

GB Search Report, dated Jan. 9, 2007, directed to counterpart GB Patent Application No. 0618493.1; 1 page.

International Search Report and Written Opinion, mailed Oct. 8, 2007, directed to counterpart International Patent Application No. PCT/GB2007/002532; 11 pages.

International Preliminary Report on Patentability, mailed Sep. 12, 2008, directed to counterpart International Patent Application No. PCT/GB2007/002532; 6 pages.

* cited by examiner

CLEANING APPLIANCE

REFERENCE TO RELATED APPLICATIONS

This application is a national stage application under 35 USC 371 of International Application No. PCT/GB2007/002532, filed Jul. 6, 2007, which claims the priority of United Kingdom Application Nos. 0614238.4 and 0618493.1, filed Jul. 18, 2006, and Sep. 20, 2006, respectively, the contents of which prior applications are incorporated herein by reference.

FIELD OF THE INVENTION

The invention relates to a handheld cleaning appliance particularly, but not exclusively, to a handheld vacuum cleaner.

BACKGROUND OF THE INVENTION

Handheld vacuum cleaners are well known and have been manufactured and sold by various manufacturers for several years. Typically, a handheld vacuum cleaner comprises a casing which houses a motor and fan unit for drawing air into the cleaner via an inlet, and a separation device such as a filter or bag for separating dirt and dust from the incoming airflow. Examples of this type of vacuum cleaner are shown in GB1207278 and EP 1452118A. Handheld vacuum cleaners have more recently been developed to incorporate cyclonic separation systems which are capable of removing larger items of debris from the airflow before removing finer particles using a filter or other barrier means. An example of such a device is sold by Black & Decker under the trade name DUSTBUSTER®. A further example of a handheld vacuum cleaner incorporating a cyclonic separator is shown in GB2035787A.

Whilst handheld vacuum cleaners incorporating cyclonic separators are efficient at separating dirt and dust from the incoming airflow, it is still prudent to provide a fine dust filter upstream of the motor to ensure that no dust can enter the motor and cause it to become damaged or unbalanced. It is therefore an object of the invention to provide a cyclonic handheld cleaning appliance in which the motor is protected without adversely affecting the ability of the cleaner to operate efficiently.

BACKGROUND OF THE INVENTION

The invention provides a handheld cleaning appliance comprising a dirty air inlet, a clean air outlet and a separator for separating dirt and dust from an airflow in an airflow path leading from the air inlet to the air outlet, the appliance further comprising a body housing a fan and motor for drawing air into the appliance via the dirty air inlet and the separator including at least one cyclone, characterised in that the separator and the body are releasably connected together about a chamber in the airflow path which is formed partly by the body and partly by the separator, the chamber housing a filter which is located upstream of the fan and motor and downstream of the or each cyclone.

By providing the handheld vacuum cleaner with a body and a separator which are releasably connected to one another about a chamber which houses a filter, the area of the filter can be made relatively large in comparison to the average cross-sectional area of the airflow path through the appliance. This is also achieved without adversely affecting the overall size of the appliance.

Preferably, the filter has an upstream surface having an area which is at least three times, more preferably at least five times, the cross-sectional area of the dirty air inlet. This ensures that the pressure drop across the filter is kept to a minimum.

In a preferred embodiment, the body and the separator are connected in a plane and the filter lies substantially in the said plane or adjacent the said plane and parallel thereto. This enables the filter to be easily accessed for regular maintenance which also enhances the performance of the appliance.

BRIEF DESCRIPTION OF THE DRAWINGS

An embodiment of the invention will now be described with reference to the accompanying drawings, in which.

DETAILED DESCRIPTION OF THE INVENTION

Figure 1:
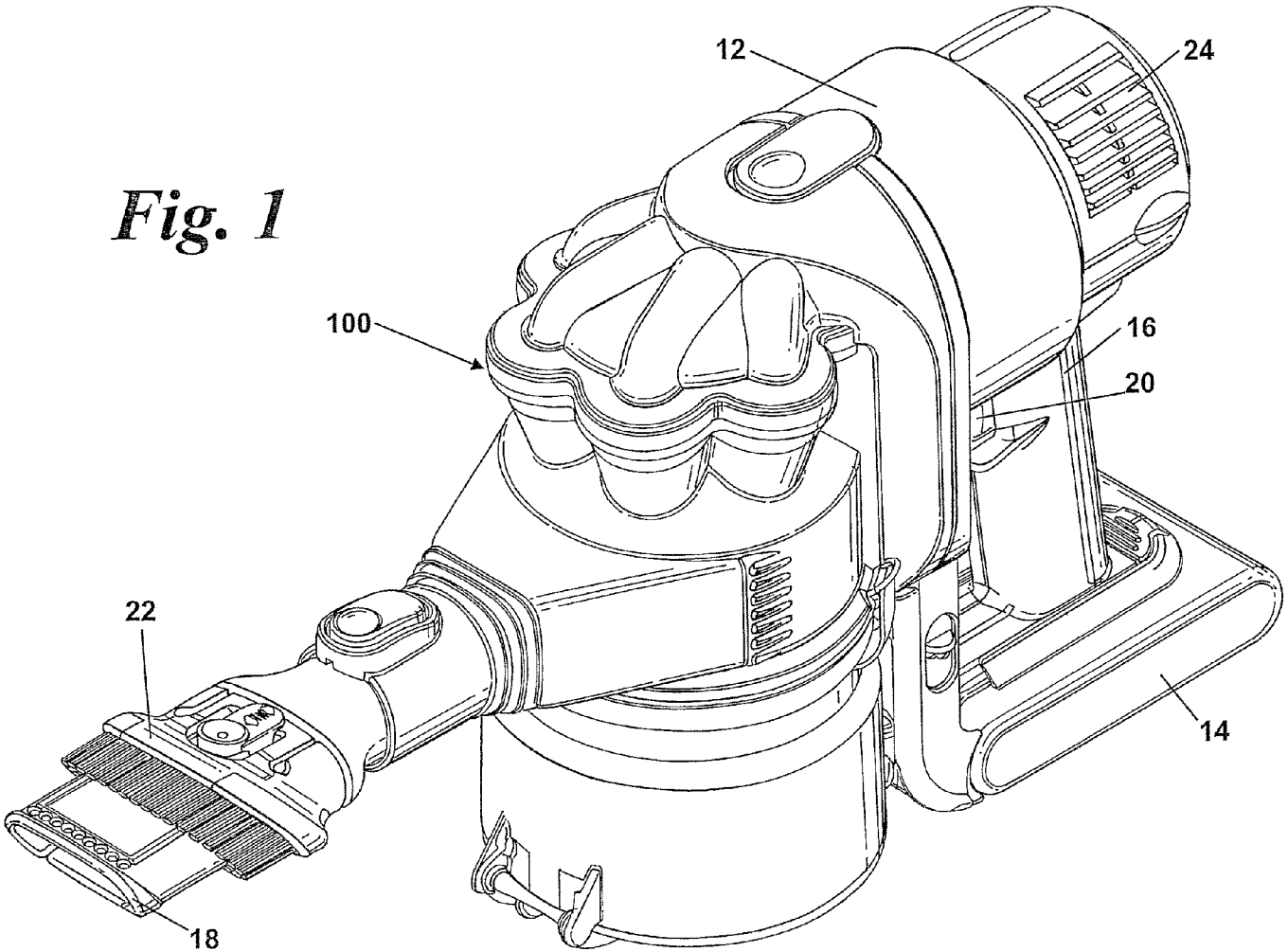
FIG. 1 shows a handheld cleaning appliance according to the invention.
Figure 2:
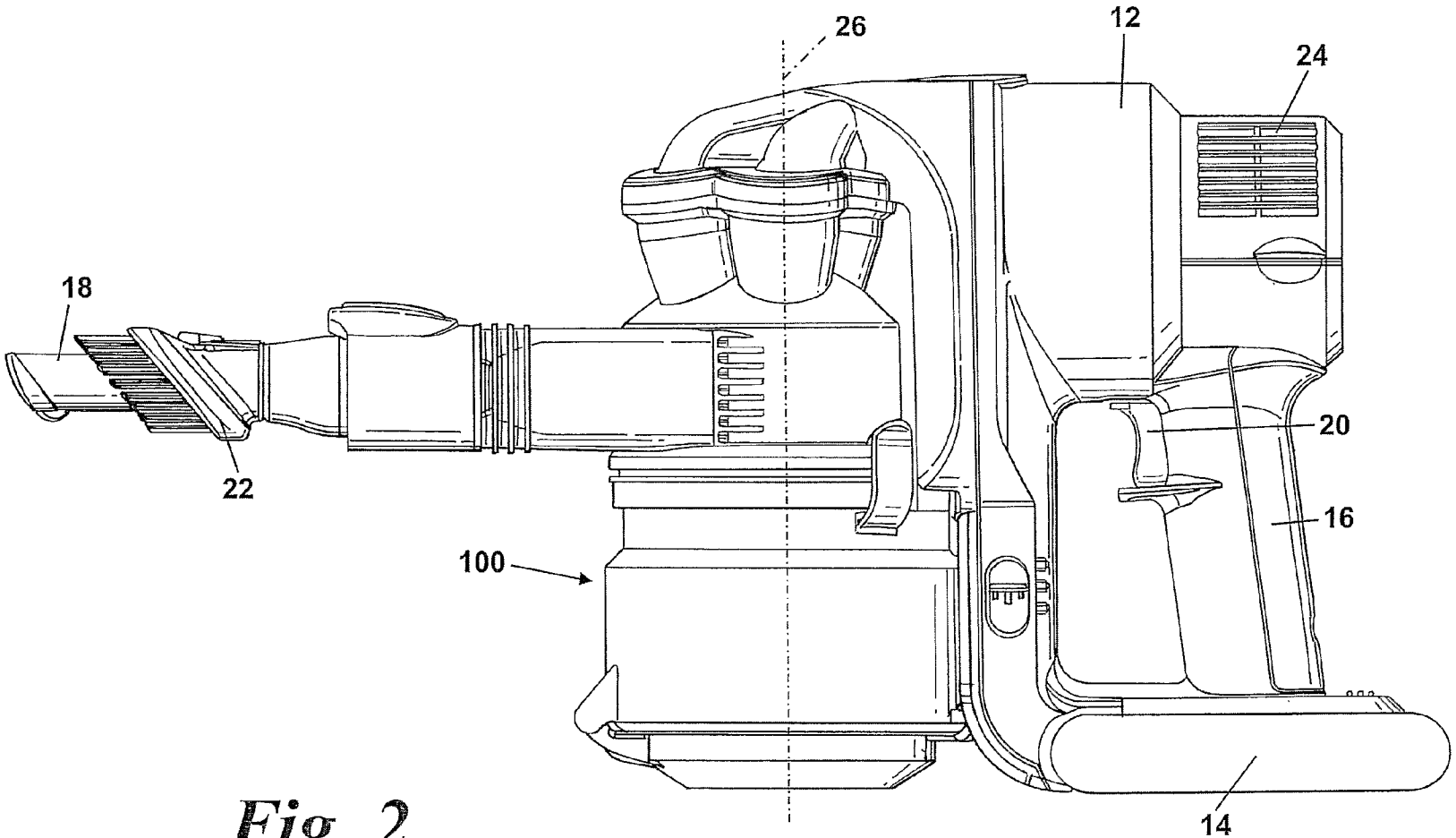
FIG. 2 is a side view of the appliance of FIG. 1.

FIGS. 1 and 2 show a handheld vacuum cleaner 10. The handheld vacuum cleaner 10 has a main body 12 which houses a motor and fan unit (not shown). The main body 12 also includes a power source 14 such as a battery. A handle 16 is provided on the main body 12 for manipulating the handheld vacuum cleaner 10 in use. A cyclonic separator 100 is attached to the main body 12. A dirty air inlet 18 extends from a portion of the cyclonic separator 100 away from the main body 12. A brush tool 22 is slidably mounted on the distal end of the dirty air inlet 18. A set of exhaust vents 24 are provided on the main body 12 for exhausting air from the handheld vacuum cleaner 10.

The cyclonic separator 100 is located between the main body 12 and the dirty air inlet 18. The dirty air inlet 18 is mounted directly on the cyclonic separator 100 on the side remote from the main body 12. Consequently, the cyclonic separator 100 is located between the handle 16 and the dirty air inlet 18. The cyclonic separator 100 has a longitudinal axis 26 which extends in a generally upright direction so that the axis 26, and therefore the cyclonic separator 100, lies substantially parallel to the direction in which the handle 16 extends.

The orientation of the handle 16 is such that, when the user grips the handle 16, the user's hand forms a fist in a manner similar to that adopted when gripping a saw. This ensures that the user's wrist is not strained more than necessary when manipulating the handheld vacuum cleaner 10 for cleaning purposes. The cyclonic separator 100 is positioned close to the handle 16 which also reduces the moment applied to the user's wrist when the handheld vacuum cleaner 10 is in use. The handle 16 carries an on/off switch 20 in the form of a trigger for turning the vacuum cleaner motor on and off.

Figure 3:
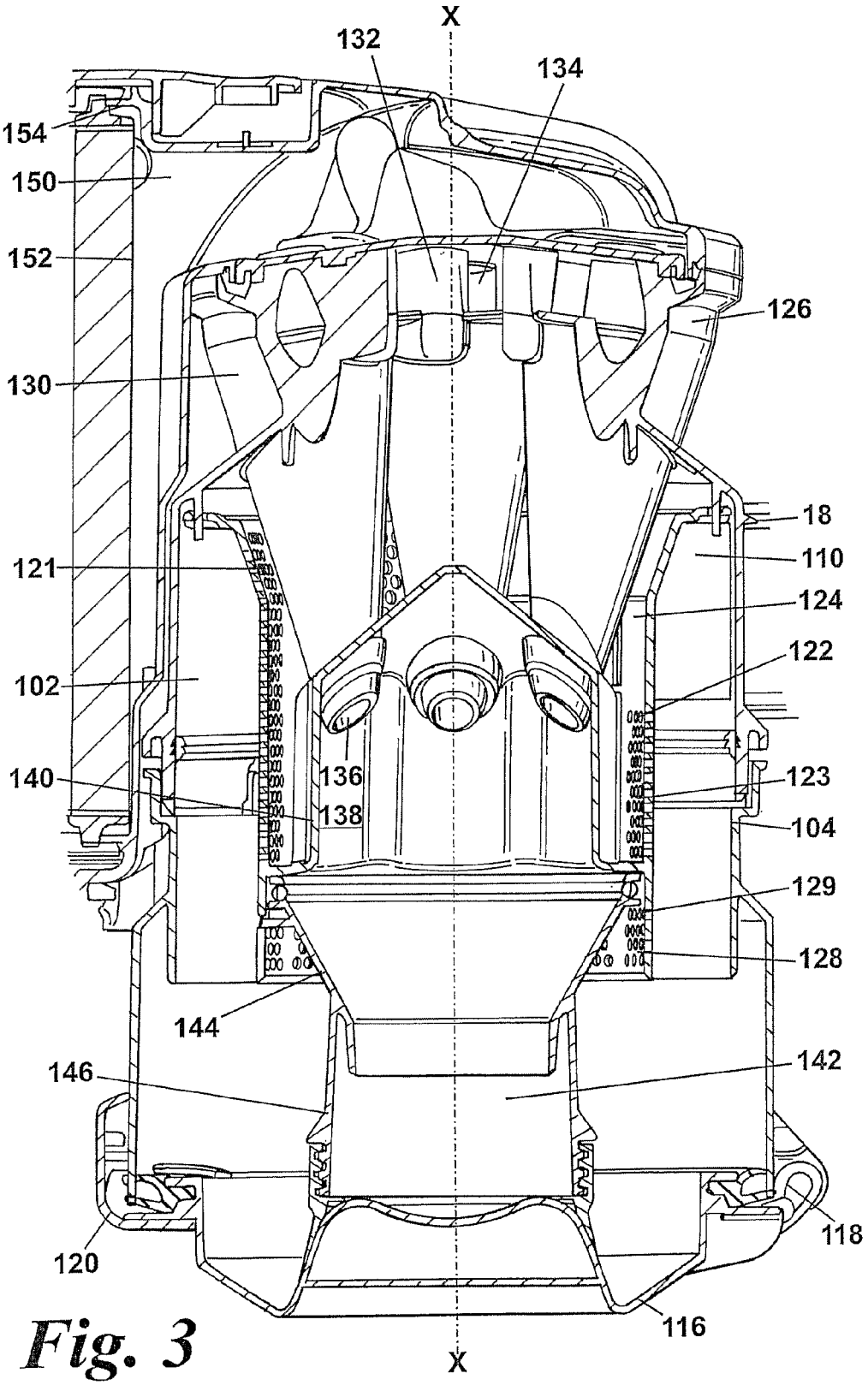
FIG. 3 is a longitudinal cross section through the cyclonic separating apparatus forming part of the appliance of FIG. 1.

The cyclonic separator 100 forming part of the handheld vacuum cleaner 10 is shown in more detail in FIG. 3. The cyclonic separating apparatus 100 comprises a first cyclone 102 which has a longitudinal axis X-X and a wall 104. An inlet 110 is formed in the upper portion of the wall 104. The inlet 110 is in communication with the dirty air inlet 18 and forms a communication path between the dirty air inlet 18 and the interior of the first cyclone 102. The air inlet 110 is arranged tangentially to the first cyclone 102 so that the incoming air is forced to follow a helical path around the interior of the first cyclone 102.

A base 116 closes one end of the first cyclone 102. The base 116 is pivotably mounted on the lower end of the first cyclone wall 104 by means of a hinge 118. The base 116 is retained in a closed position (as shown the figures) by means of a catch 120.

A shroud 121 is located inwardly of the wall 104 of the first cyclone 102. The shroud 121 comprises a part-cylindrical, part frustoconical wall 122 having a plurality of through-holes 123. The shroud 121 surrounds an outlet 124 from the first cyclone 102. The outlet 124 provides a communication path between the first cyclone 102 and a second cyclone assembly 126. A lip 128 is provided at the base of the shroud 121. The lip 128 has a plurality of through-holes 129 which are designed to allow air to pass through but to capture dirt and dust.

The second cyclone assembly 126 comprises a plurality of second cyclones 130 arranged in parallel with one another. In this embodiment, six second cyclones 130 are provided. The second cyclones 130 are arranged around the axis X-X of the first cyclone 102. The arrangement of the second cyclones 130 is such that the second cyclones are spaced equi-angularly around the axis X-X. Each second cyclone 130 has a tangentially-arranged air inlet 132 and an air outlet 134. Each air inlet 132 and air outlet 134 is located at a first end of the respective second cyclone 130. A cone opening 136 is located at a second end of each second cyclone 130. The plane of the cone opening 136 of each second cyclone 130 is inclined with respect to a longitudinal axis (not shown) of the respective further cyclone 130. The cone opening 136 of each of the second cyclones 130 is in communication with a passageway 138 defined by a wall 140 located inwardly of the shroud 121.

The second end of each second cyclone 130 projects into the interior of the first cyclone 102. However, the first end of each second cyclone 130 lies outside the envelope of the first cyclone 102. In the orientation shown, it is the lower end of each second cyclone 130 which projects into the upper end of the first cyclone 102. The inlet 110 is also arranged at the upper end of the first cyclone 102 so that the inlet 110 is located in the region of the cyclonic separator 100 in which the first and second cyclones 102, 130 overlap. Because the first ends of the second cyclones 130 lie outside the envelope of the first cyclone, this region of the cyclone separator 100 lies intermediate the upper end of the cyclone separator 100 and the lower end of the cyclone separator 100. Connecting the dirty air inlet 18 to the cyclone separator 100 at an intermediate portion thereof is beneficial for the manipulation of the handheld vacuum cleaner 10 and avoids the lower extremities of the appliance being accidentally knocked on surfaces away from the area being cleaned.

A collector 142 is located at the lower end of the passageway 138. The collector 142 comprises a frustoconical first portion 144 and a cylindrical second portion 146. The interior of the collector 142 is delimited by the base 116 and the sides of the first and second portions 144, 146 of the collector 142.

Each of the air outlets 134 of the second cyclones 130 is in communication with a duct 150. The duct 150 provides an airflow path from the cyclonic separating apparatus 100 into other parts of the handheld vacuum cleaner 10. Located at the downstream end of the duct 150 is a recess 152 which is much larger in cross-sectional area than the duct 150. The purpose of the recess 152 will be described in further detail below.

In normal use, when the on/off switch 20 is depressed, the motor and fan unit draws a flow of dirt-laden air into the dirty air inlet 18 and then into the cyclonic separator 100. Dirt-laden air enters the cyclonic separator 100 through the inlet 110. Due to the tangential arrangement of the inlet 110, the airflow is forced to follow a helical path around the interior of the wall 104. Larger dirt and dust particles are separated by cyclonic motion around the wall 104. These particles are then collected at the base 116 of the first cyclone 102.

The partially-cleaned airflow then flows back up the interior of the first cyclone 102 and exits the first cyclone 102 via the through-holes in the shroud 121. Once the airflow has passed through the shroud 121, it enters the outlet 124 and from there is divided between the tangential inlets 132 of each of the second cyclones 130. Each of the second cyclones 130 has a diameter which is smaller than that of the first cyclone 102. Therefore, the second cyclones 130 are able to separate smaller particles of dirt and dust from the partially-cleaned airflow than the first cyclone 102. Separated dirt and dust exits the second cyclones 130 via the cone openings 136. Thereafter, the separated dirt and dust passes down the passageway 138 and into the collector 142. The separated dirt and dust eventually settles at the bottom of the collector 142 on the base 116.

Cleaned air then flows back up the second cyclones 130, exits the second cyclones 130 through the air outlets 134 and enters the duct 150. The cleaned air then passes from the duct 150 sequentially through the pre-motor filter 152, the motor and fan unit, and a post-motor filter before being exhausted from the vacuum cleaner 10 through the air vents 24.

The first cyclone 102 and the collector 142 can be emptied simultaneously by releasing the catch 120 to allow the base 116 to pivot about the hinge 118 so that the separated dirt and dust can fall away from the cyclonic separator 100. This allows efficient and reliable emptying of the dirt and dust from the cyclonic separator 100 at periodic intervals convenient to the user.

Figure 4:
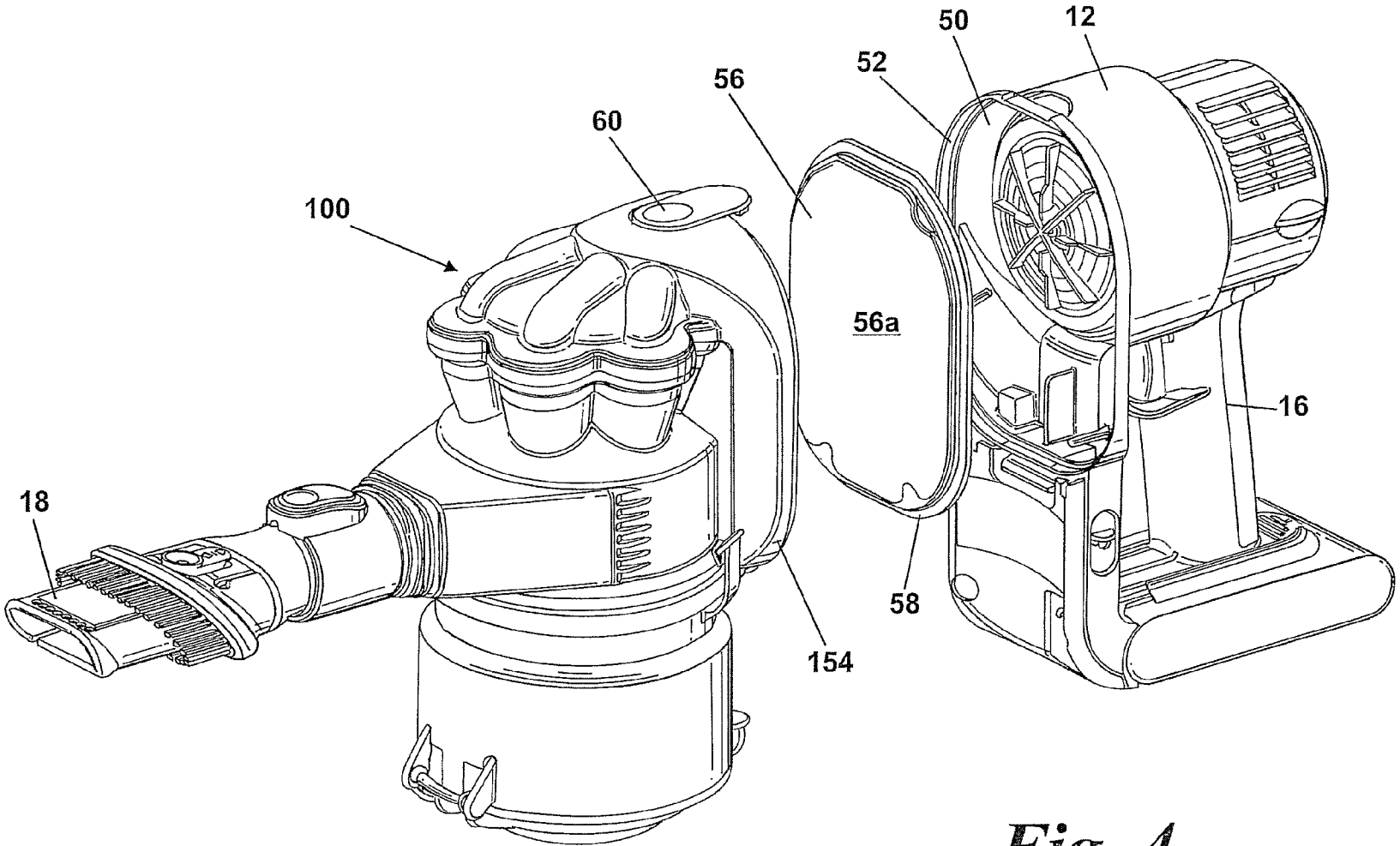
FIG. 4 is a perspective view showing separator of the appliance of FIG. 1 released from the body thereof.

FIG. 4 shows the main body 12 of the handheld vacuum cleaner 10 separated from the cyclonic separator 100. As can be seen in FIG. 4, the main body 12 comprises a recess 50 delimited by a lip 52. This recess 50 corresponds to the recess 152 formed in the cyclonic separator 100. The recess 152 is surrounded by a lip 154 which is dimensioned and designed to cooperate with the lip 52. The dimensions of the lips 52, 154 are such that, when the body 12 and the separator 100 are brought into connecting engagement, the lips 52, 154 overlap in a sealing manner. The two recesses 50, 152 then combine to form a chamber in which a pre-motor filter 56 is housed. The filter 56 has a sealing rim 58 which abuts against one of the lips 52, 154 so that air cannot pass between the filter 56 and the lip 52, 154. The cyclonic separator 100 and the main body 12 are held in this position by a catch 60.

In its operative position, the filter 56 lies in or directly adjacent the plane in which the lips 52, 154 lie. The filter 56 also fills the entire area within the lips 52, 154 so as to maximise the area of the filter 56 which is presented to the airflow passing through the appliance 10. The area of the upstream surface 56*a* of the filter 56 is designed to be as large as possible in comparison to the area of the dirty air inlet 18. This reduces the pressure drop across the filter 56 and also increases the period between necessary maintenance washes of the filter 56. The area of the upstream surface 56*a* of the filter 56 is more than five times the cross-sectional area of the dirty air inlet 18.

When the cyclonic separator 100 is to be released from the body 12, the catch 60 is depressed to allow the lips 52, 154 to be separated from one another. The removal of the separator 100 from the body 12 thus reveals the filter 56 allowing access for washing or replacement.

The invention is not limited to the precise details of the embodiment described above. For example, the separator need not be cyclonic. If it is, the number of second cyclones can be varied, as can the detail of their design, such as their cone angle, axis inclination and cone opening inclination. The collected dirt and dust can be released in other ways, such as by complete removal of the lower portion of the first cyclone 102, and the location of the on/off switch may be varied. The shape of the chamber and filter can be varied, as can the area in comparison to the area of the dirty air inlet.

The invention claimed is:

1. A handheld cleaning appliance comprising a dirty air inlet, a clean air outlet and a separator for separating dirt and dust from an airflow located in an airflow path leading from the air inlet to the air outlet, the appliance further comprising a body housing a fan and motor for drawing air into the appliance via the dirty air inlet, wherein the separator comprises at least one cyclone and an outlet duct, the separator and the body being releasably connected together about a chamber in the airflow path downstream of the outlet duct and which is formed partly by the body and partly by the separator, the chamber housing a filter which is located upstream of the fan and motor.

2. The handheld cleaning appliance of claim 1, wherein the dirty air inlet is mounted directly on the separator and is removable from the body with the separator.

3. The handheld cleaning appliance of claim 1 or 2, wherein the filter has an upstream surface having an area which is at least three times the cross-sectional area of the dirty air inlet.

4. The handheld cleaning appliance of claim 3, wherein the upstream surface of the filter has a cross-sectional area that is at least five times the cross-sectional area of the dirty air inlet.

5. The handheld cleaning appliance of claim 3, wherein the body and the separator are connected in a plane and the filter lies substantially in the said plane or adjacent the said plane and parallel thereto.

6. The handheld cleaning appliance of claim 3, wherein the clean air outlet is located in the body.

7. The handheld cleaning appliance of claim 1 or 2, wherein the body and the separator are connected in a plane and the filter lies substantially in the said plane or adjacent the said plane and parallel thereto.

8. The handheld cleaning appliance of claim 1 or 2, wherein the clean air outlet is located in the body.

* * * * *